United States Patent [19]

Wildbolz

[11] 4,399,590

[45] Aug. 23, 1983

[54] METHOD AND APPARATUS FOR CHECKING A BLENDING PLANT FOR TEXTILE STAPLE FIBRES

[75] Inventor: Rudolf Wildbolz, Winterthur, Switzerland

[73] Assignee: Rieter Machine Works Ltd., Winterthur, Switzerland

[21] Appl. No.: 282,957

[22] Filed: Jul. 13, 1981

[30] Foreign Application Priority Data

Jul. 23, 1980 [CH] Switzerland ..... 5610/80

[51] Int. Cl.[3] ..... D01G 13/00

[52] U.S. Cl. ..... 19/145.5; 19/105; 19/297

[58] Field of Search ..... 19/297, 105, 145.5, 19/145.7

[56] References Cited

U.S. PATENT DOCUMENTS

| | | | |
|---|---|---|---|
| 2,156,893 | 5/1939 | Gaus et al. | 19/297 |
| 2,166,811 | 7/1939 | Gaus | 19/297 |
| 2,320,544 | 6/1943 | Gaus et al. | 19/297 X |
| 3,110,182 | 11/1963 | Moss et al. | 19/297 X |
| 4,103,398 | 8/1978 | Rhyne et al. | 19/145.5 |
| 4,301,573 | 11/1981 | Gunter et al. | 19/105 X |

*Primary Examiner*—Louis Rimrodt

*Attorney, Agent, or Firm*—Werner W. Kleeman

[57] ABSTRACT

A method of, and apparatus for, checking a plant for blending textile staple fibres of different types, which are supplied by fibre metering units. The supply of fibres to the storage device is interrupted during repeated time intervals. According to the invention the fibres supplied by an individually operated fibre metering unit, supplying a constant quantity, during part time intervals within the time intervals are transported to a quantity measuring device and are measured.

The present invention permits very reliable and precise checking of the fibre quantities supplied by the fibre metering units in such a manner that a desired blending proportion can be maintained precisely. The machines fed from the storage device can be maintained operating during the checking periods, i.e. at all times. The checking operations thus can be effected within relatively short time intervals in such manner that deviations from a pre-set desired value are detected early and that also relatively short-term deviations can be detected.

12 Claims, 3 Drawing Figures

METHOD AND APPARATUS FOR CHECKING A BLENDING PLANT FOR TEXTILE STAPLE FIBRES

BACKGROUND OF THE INVENTION

The present invention concerns a method of checking a blending plant for textile staple fibres of different types, in which each type is supplied by a fibre metering unit each to a blending device and in which the fibres blended therein are supplied to a storage device, and in which during the supply times the fibre quantity supplied to the storage device is somewhat greater than the fibre quantity taken off from this storage device, and as a consequence the fibre supply to the storage device is interrupted during repeated time intervals, the metering units during such time intervals delivering fibres individually and consecutively, which fibres are used for checking the fibre quantity supplied by the metering units during the normal blending operation.

Plants operating according to such a method are known in practical spinning mill use. They are used for fibre blends composed of fibres of different types or kinds. A blend e.g. of natural and man-made fibres, or fibres of different colours or different qualities can be processed. It is important in this process that the fibre blends as well as yarns or twisted threads processed therefrom are uniform. The fibres delivered from the blending plant, or tufts are to represent a blending proportion, which is within sharply defined tolerance limits. If e.g. a base material for the production of clothing articles is processed, deviations from the tolerance limits can present a breach of legal requirements.

The checking methods already known, in which the checking is effected during the time intervals, during which the fibre supply to the storage device or to the reserve chute is interrupted, show as a disadvantage of relatively great imprecision. The cause for this is seen in that the fibre quantity supplied by an individually operating metering unit during the start-up and running-out phases of the supply deviates considerably from the fibre quantity supplied during normal operation at constant values. If the imprecision caused by these deviations are to be eliminated, the disadvantage of a prolonged measuring time is to be incurred. Thus, more fibre material is to be used for the measuring operation, and the measurements can be effected less frequently. Thus the checking operation is of reduced quality and becomes more expensive.

In such cases, in which only one check is effected per working shift, the individually operated metering unit can be running during a relatively long period of time, in such a manner that the deviations from the fibre quantity of constant value occurring during the start-up and running-out phases no longer are of substantial influence. In this case, however, a standstill period of the machine arranged subsequent to the blending plant during the checking operation is to be incurred.

SUMMARY OF THE INVENTION

According to the present invention a sufficient precision of the blend proportion is to be ensured in simple manner, and the disadvantages mentioned are to be eliminated in that during such part time periods within repeated time intervals, during which a constant fibre supply rate prevails, the fibres supplied are transported to a quantity measuring device and are measured.

The apparatus for implementing the method comprises a blending plant, which contains a plurality of fibre metering units and a blending device arranged subsequently thereof, and a storage device, the apparatus comprising a first branching device and a quantity measuring device. The apparatus is characterized in that between the first branching device and the quantity measuring device a second branching device is provided for branching the fibres to the quantity measuring device as desired.

According to the invention a very reliable and precise checking is effected of different types of fibres or fibre flocks, in such manner that the fibre quantities supplied by the fibre metering units to the blending device are metered exactly corresponding to the values preset and are maintained constant, and that thus the blend proportion is maintained precisely. Owing to the much shorter measuring time the machines processing the blended fibres further do not have to be stopped for effecting the checking operation, i.e. checking can be effected while these machines are operated in the normal manner. As compared to the method, in which one single check is effected per shift, the individual checks according to the present invention can be effected at much shorter time intervals. This presents the substantial advantages, that deviations from the values pre-set are detected sooner, and that additionally also deviations extending over relatively short periods of time can be detected.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
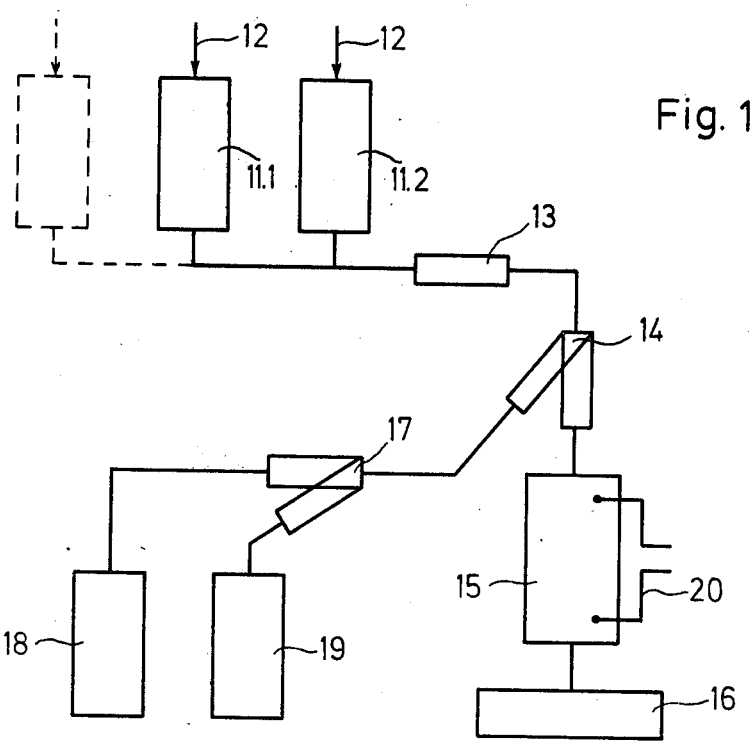
FIG. 1 is a schematic view of an inventive apparatus.

The apparatus shown in FIG. 1 comprises two or more fibre metering devices 11 (11.1 and 11.2), to which, as indicated by arrows 12, fibre material mainly consisting of fibre flocks, but also containing individual fibres, is supplied.—In the description and in the claims the fibre material consisting of fibre flocks and of individual fibres is referred to as "fibres" throughout.—The metering units 11 are designed in such a manner, that they supply during operation always a constant and settable weight quantity of fibres per time unit. To each metering unit 11 fibres of a determined type are supplied, fibres of different types being supplied to the different metering units 11.1 and 11.2. The fibre quantities supplied per time unit by the different metering units 11 generally are chosen differently. As an example of a practical application, a supply of 67% cotton on the metering device 11.1 and a supply of 33% polyester on the metering unit 11.2 can be chosen, the percentage figures indicating the weight ratio of the respective fibre quantities supplied per time unit. In most practical applications two or four metering units 11 are in operation subsequent. Subsequently to, or downstream from, the metering units a blending device 13, and thereafter a first branching device 14 are provided. From said branching device 14 the fibres are transferred, if the branching device 14 is in its through position, to a storage device 15, and from there to subsequent further processing machines, e.g. to cards 16. In another switched position of the first branching device 14 the fibres are branched off to a second branching device 17, by which they are either transmitted, to a receiver 18, when the branching device 17 is in its straight-thru condition or position, or to a quantity measuring device 19, e.g. a balance, when the branching device 17 is in a "diverting" condition or position.

Figure 2:
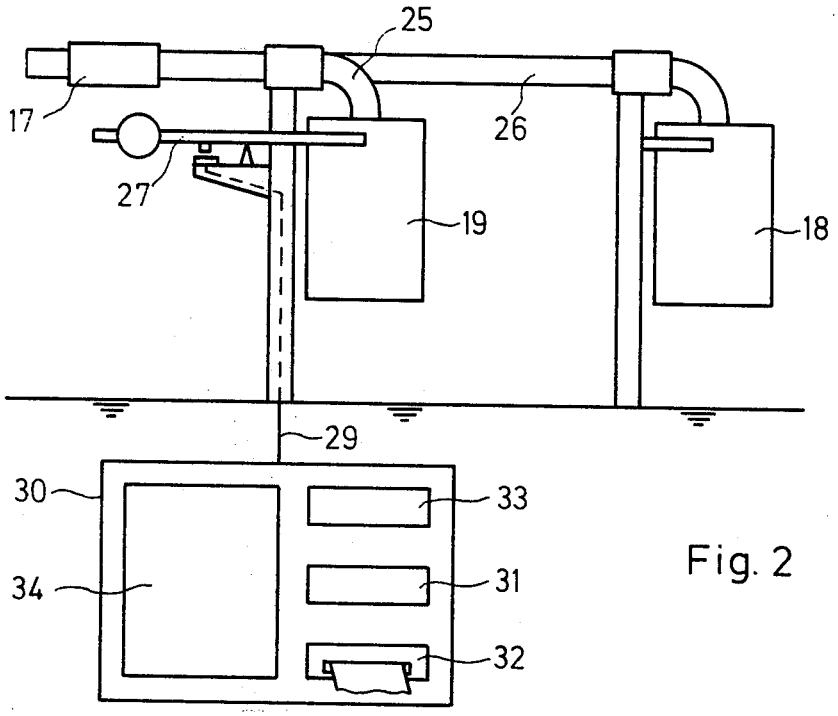
FIG. 2 is a view showing details of the arrangement for measuring the fibre quantity supplied by a individually operated metering unit.

The arrangement comprising the elements 17, 18 and 19 is used for measuring the fibre quantities supplied by the fibre metering units 11 and is shown in greater detail again in FIG. 2. In the example shown a pneumatic fibre transport via ducts is assumed to be used. The fibre ducts designed as tubes 25 and 26 lead from the second branching device 17 to the quantity measuring device 19, and to the receiver or recipient 18, respectively. The quantity measuring device 19 is designed as a balance in such a manner that the fibres supplied to it can be weighed using a weighing device 27. An evaluating device 30 is connected via an electric connection 29 with the weighing device 27. It is provided with a keyboard 31 for information input values, an information or data output point 32 and a display 33.

For keeping the cards 16 operating without interruption the storage device 15 at all times must contain fibre material. In order to ensure this, somewhat more material is supplied to it during the supply times, than is used by the cards 16. The storage device 15 is provided with a signal device 20, which transmits a signal if the minimum and the maximum filling level of the storage device 15 is reached. Control of the filling level can e.g. be effected by photocell light barriers provided in the storage device 15 or by the weight exerted by the fibres. The signals generated by the device 20 are transmitted to a control device 34, which can be e.g. located in the evaluating device 30.

In operation of the plant shown in FIG. 1 one type each of fibres is supplied at all times to each of the fibre metering units 11. The fibres delivered by each of the metering units 11 are transported to the blending device 13, where they are blended intimately. If the fibres, as assumed in this example, are transported pneumatically via tubes, automatic blending is obtained in the tube fed by the metering units 11 in such manner that this tube functions as a blending device. In normal operation the branching device 14 is set such that the blended fibres are transported to the storage device 15 and from there to the machines for further processing, such as e.g. the cards 16.

Using the keyboard 31 the data for the desired production corresponding to the desired blending proportion are fed into the evaluating device 30 where they are stored.

As soon as a signal from the storage device 15 indicates that the maximum filling level is reached therein the fibre metering units 11 are stopped. Thereupon a flushing time period follows during which fibres still present in the fibre transporting ducts can be transported into the storage device 15. If now a checking operation is programmed, the branching device 14 is switched from the through position to the branching-off position, and simultaneously the unit to be checked, e.g. the metering unit 11.1 is started in such manner that only this unit delivers fibres. The fibres are transported via the branching devices 14 and 17 to the receiver or recipient 18. After a short start-up time, after which the corresponding fibre metering unit 11.1 has reached again its normal production rate, the branching device 17 is switched from its through position to its branched-off position, in such a manner that the fibres no longer are transported into the receiver or recipient 18, but are guided to the quantity measuring device 19. The duration of fibre supply to the quantity measuring device 19 is pre-set at the beginning with the input-data fed using the keyboard 31. Upon completion of this time duration of fibre supply to the quantity measuring device 19 the branching device 17 again is switched to its through position directing the fibres towards the receiver or recipient 18. Simultaneously the individually operated fibre metering unit 11.1 is brought to a standstill. As soon as upon a second flushing time period fibres still remaining in the fibre duct are eliminated, also the branching device 14 is switched back to its through position leading to the storage device 15 in such manner that the plant is ready again to resume the normal operation. The plant is re-activated as soon as the signalling device 20 transmits the signal indicating the minimum filling level in the storage device 15.

Weighing of the material deposited in the quantity measuring device 19 can be effected automatically, the weight measured being indicated on the display 33. The weight of the fibres which are brought into the quantity measuring device 19 from the various units 11 during the respective checking operations also can be continuously printed onto an information tape at the information or data output point 32.

Figure 3:
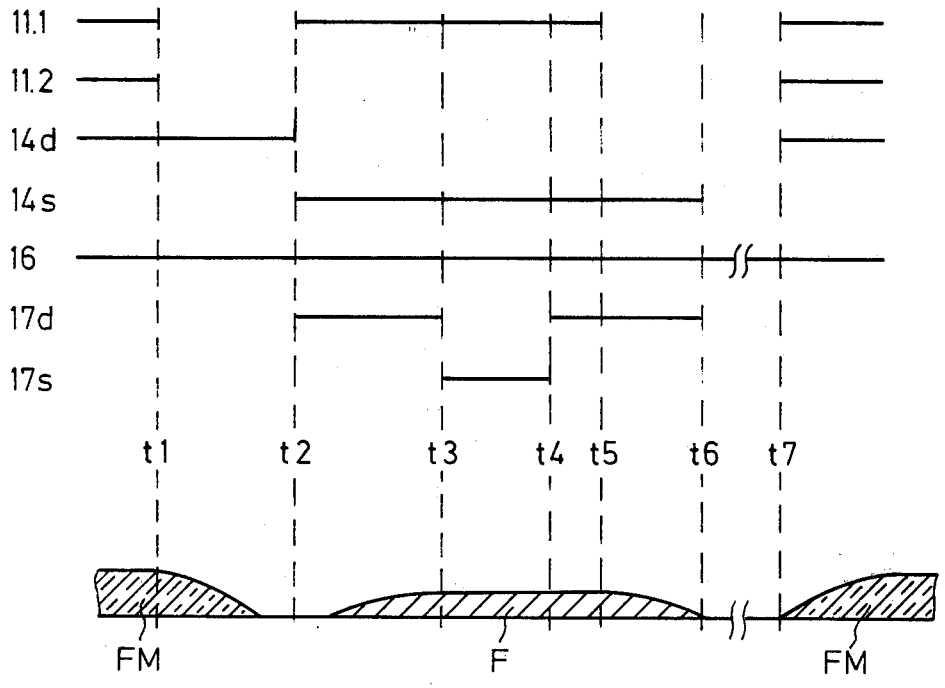
FIG. 3 is a diagrammatic view of the operating sequence of the checking operation.

The operating sequence described above is also shown diagrammatically in FIG. 3 for better clarity. The time elapsed is plotted horizontally. The solid lines indicate that the corresponding device is in operation. As shown in FIG. 3, during normal blending operation (before the time moment t1) the metering units 11 and the cards 16 are in operation. The branching device 14 is in its through position 14*d* leading to the storage device 15. Upon stopping of the metering units 11 the branching device 14 remains in its through position (14*d*) leading to the storage device 15 during the first flushing time period, extending from the time moment t1 to the time moment t2. Upon completion of this flushing time period at the time moment t2 the branching device 14 is switched in such manner that the fibres are branched-off in the direction (14*s*) to the branching device 17. This latter branching device 17 at this moment in time is in its through position (17*d*) leading to the receiver or recipient 18. Furthermore, if e.g. the unit 11.1 is to be checked, this unit is restarted.

At the time moment t3 the branching device 17 is switched to its branched-off position (17*s*) in such manner that the fibres are directed to the quantity measuring device 19. The supply of fibres to the quantity measuring device 19 is effected during the part time interval between the time moments t3 and t4 within the time interval extending from the time moment t1 to the time moment t7. The branching device 17 is switched back to the through position (17*d*) at the time moment t4. At the time moment t5 the metering unit 11.1 is stopped again, whereupon fibres remaining in the fibre ducts are flushed into the receiver or recipient 18, which is terminated at the time moment t6.

As soon as at the time moment t7 the signalling device 20 transmits the signal indicating that the minimum filling level has been reached, the metering units 11 are restarted and the branching device 14 is switched back to its through position (14*d*) leading to the storage device 15 at the latest at this time moment t7.

In the lower part of FIG. 3 additionally a fibre quantity F supplied by the metering unit 11.1 is indicated. It is visualized how this quantity increases from the start of the unit 11.1 from the time moment t2 on, and decreases again from the time moment t5 on as the unit is brought to a standstill. Additionally the fibres FM delivered during simultaneous operation of both units 11.1 and 11.1 is indicated.

In an already known checking method, already mentioned, for checking the metering units, the whole fibre quantity delivered by them during a given time interval, i.e. the fibre quantity F indicated in the application example at the bottom, is weighed, and as a time interval the time period extending from the time moment t2 to the time moment t6 is chosen. In this procedure the imprecision of the measurement caused by the increasing and decreasing fibre quantities supplied during the start-up and stopping phases (from t2 to t3 and from t5 to t6 respectively) is incurred if this checking procedure is applied. In another checking procedure, elimination of the deviation, caused by the imprecise measurement during the start-up and the stopping phases, is aimed at by chosing relatively large fibre quantities to be used for the checking measurement, in such a manner that this imprecision compared to the total quantity of fibres becomes practically irrelevant. A checking operation according to this latter procedure, however, cannot be effected without interruption of the operation of the cards 16 or of another subsequent machine.

According to the present invention the fibre quantity taken out for measurement now is limited to the part time or partial time interval between the time moments or time t3 and t4. As the fibre quantity supplied per time unit remains constant throughout this whole part time or partial time interval, no deviations whatsoever from the effective fibre quantity delivered by the metering unit to be checked occur during this part time interval (t3 to t4) upon which the measurement is based actually.

For visualizing the situation if different blend proportions are applied, it is to be assumed in the following, that two fibre metering units 11.1 and 11.2 supply 300 kg fibres per hour, and that the time duration corresponding to the part time interval between the time moments t3 and t4 is 12 seconds. Under these conditions $$(300\ \text{kg} \times 12\ \text{s})/3600\ \text{s} = 1\ \text{kg}$$

fibres are supplied in normal operation during 12 seconds. At a blending proportion of 50% each, during 12 seconds each metering unit supplies 500 g fibres in such manner that during each checking operation 500 g fibres are supplied to the quantity measuring device 19.

At another blending proportion, of 85% and 15% respectively, one of the metering units supplies 850 g, and the second metering device supplies 150 g of fibres per weighing operation, i.e. during a time interval of 12 s. These quantities are called charges. If charges of the same weight are desired for the checking operations, the pre-set measuring times (fed as input values to the keyboard 31 of the evaluating device 30) at a total measuring time of 24 seconds for both units 11.1 and 11.2 are to be chosen as 3,6 s for the unit supplying 85% of the fibres and as 20,4 s for the unit supplying 15% of the fibres.

The values indicate the approximate limits of the variations of the blending proportion, for which the present invention is particularly suited.

In summary, then, there has been disclosed according to the invention, a method of checking the rate of supply of textile fibres in a plant in which supply of fibres on a main supply path is occasionally interrupted, the supply of fibres being restarted during a period of interruption of supply on the main supply path and being diverted to an auxiliary path for checking, the check occurring only after the supply rate on said auxiliary path has risen to a level equal to a normal level for continuous operation. Thus, transient effects due to restarting of the supply do not affect the check.

The apparatus for performing the method may comprise diverter means for selectively diverting a supply of fibres from a main supply path to a first auxiliary supply path or a second auxiliary supply path, one of which auxiliary supply paths leads to a checking device. The diverter means may comprise a first diverter for selectively diverting supply from said main supply path to a branch path therefrom, and a second diverter for selectively diverting supply from said branch path to one or other of said first and second auxiliary paths.

While there are shown and described present preferred embodiments of the invention, it is to be distinctly understood that the invention is not limited thereto, but may be otherwise variously embodied and practiced within the scope of the following claims. Accordingly,

What I claim is:

1. A method of checking a blending plant for textile staple fibers of different types, comprising the steps of:

transporting each type of fiber by means of a respective fiber metering unit to a blending device;

blending the fibers received from said fiber metering units in said blending device;

transporting the blended fibers from the blending device into a storage device from which the blended fibers are removed;

delivering quantities of the blended fibers from the blending device to the storage device during the times of supplying the blended fibers between the blending device and the storage device which are somewhat greater than the fiber quantity removed from said storage device;

interrupting the fiber supply of blended fibers to the storage device during repeated time intervals;

during at least certain of said time intervals causing the metering units supplying the different types of fibers to the blending device to supply fibers thereto individually and in succession;

utilizing the fibers supplied individually and in succession by each of the metering units to the blending device for checking the quantity of fibers supplied by each of the metering units during a normal blending operation;

during partial time periods within the repeated time intervals, during which there prevails a substantially constant fiber supply from at least one of the metering units to be checked, supplying the entire production of fibers from said at least one metering unit, to a quantity measuring device; and measuring the entire production of fibers supplied by said at least one metering unit to the quantity measuring device therein.

2. The method as defined in claim 1, further including the steps of:

during one said time interval supplying to a receiver, from the totality of the fibers supplied during said one time interval, the fibers supplied outside of the partial time period of said one time interval during which there prevails said substantially constant fiber supply.

3. The method as defined in claim 1, further including the steps of:

pneumatically transporting the fibers.

4. A method of checking a blending plant for textile staple fibers of different types, comprising the steps of:

transporting each type of fiber by means of a respective fiber metering unit to a blending device;

blending the fibers received from said fiber metering units in said blending device;

transporting the blended fibers from the blending device into a storage device from which the blended fibers are removed;

delivering quantities of blended fibers from the blending device to the storage device during the times of supplying the blended fibers between the blending device and the storage device which are greater than the quantity of blended fibers removed from said storage device;

interrupting the supply of blended fibers to the storage device during repeated time intervals;

during at least one of said repeated time intervals placing into operation one of the fiber metering units for supplying the fibers thereof;

during a partial time period within said one time interval, during which there prevails a substantially constant fiber supply from said one fiber metering unit, supplying the entire production of fibers of said one fiber metering unit to a quantity measuring device; and measuring the entire production of fibers supplied by said one fiber metering unit to the quantity measuring device in the latter.

5. An apparatus for checking a blending plant for textile staple fibers of different types, comprising:

a plurality of individually operated fiber metering units for feeding fibers to a blending device;

a subsequently arranged blending device for blending the fibers received from said plurality of fiber metering units;

a storage device for receiving the fibers blended in said blending device;

a first branching device cooperating with said blending device and said storage device for feeding blended fibers from said blending device to said storage device;

a quantity measuring device operatively associated with said first branching device for measuring the quantity of fibers received from any given one of said fiber metering units during such time as said one fiber metering unit is delivering a substantially constant supply of fibers; and a second branching device for branching fibers received from said one fiber metering unit to the quantity measuring device.

6. The apparatus as defined in claim 5, further including:

a control device for controlling the first branching device, the second branching device and for stopping and activating the individually operated fiber metering units.

7. The apparatus as defined in claim 5, further including:

a control device for controlling the quantity measuring device and for automatically registering measuring values thereof by means of an information output data location.

8. The apparatus as defined in claim 5, wherein:

said quantity measuring device comprises balance means for weighing the fibers.

9. The apparatus as defined in claim 5, further including:

a signalling device provided for said storage device;

said signalling device serving for generating a respective signal if there is attained a minimum filling level and a maximum filling level of said storage device; and a control device with which there is operatively connected said signalling device.

10. The apparatus as defined in claim 5, wherein:

said plurality of fiber metering units comprises two of said fiber metering units; and a blend component of one of the fiber types amounts to 10% to 90% by weight.

11. The apparatus as defined in claim 5, wherein:

said quantity measuring device possesses a capacity sufficient for taking up at least ten partial weighings each amounting to approximately 500 grams of fibers.

12. The apparatus as defined in claim 5, further including:

a receiver cooperating with said second branching device; and said receiver serving to receive a portion of the quantity of fibers delivered by said one fiber metering unit during such time as said one fiber metering unit is not delivering a constant supply of fibers therefrom.

* * * * *